US009144287B2

(12) United States Patent
Yoo et al.

(10) Patent No.: US 9,144,287 B2
(45) Date of Patent: Sep. 29, 2015

(54) VIBRATION PUFF HAVING ELASTIC MOVING BODY INSIDE

(76) Inventors: Koon Il Yoo, Yongin-Si (KR); Myung Keun Bae, Namyangju-si (KR)

( * ) Notice: Subject to any disclaimer, the term of this patent is extended or adjusted under 35 U.S.C. 154(b) by 0 days.

(21) Appl. No.: 13/699,215

(22) PCT Filed: Feb. 1, 2012

(86) PCT No.: PCT/KR2012/000798

§ 371 (c)(1),
(2), (4) Date: Jul. 30, 2014

(87) PCT Pub. No.: WO2013/012148

PCT Pub. Date: Jan. 24, 2013

(65) Prior Publication Data

US 2014/0345643 A1 Nov. 27, 2014

(51) Int. Cl.

| | |
|---|---|
| ***A45D 40/26*** | (2006.01) |
| ***A45D 40/24*** | (2006.01) |
| ***A45D 33/32*** | (2006.01) |
| ***A45D 42/10*** | (2006.01) |
| ***A45D 33/36*** | (2006.01) |

(52) U.S. Cl.

CPC ..... *A45D 33/36* (2013.01); *A45D 33/32* (2013.01); *A45D 2200/207* (2013.01)

(58) Field of Classification Search

CPC ... A45D 40/26; A45D 40/262; A45D 40/264; A45D 40/265; A45D 40/0075; A45D 2200/1009; A45D 2200/1018; A45D 33/34; A45D 33/36; A45D 33/32; A45D 34/04; A45D 2200/207

USPC ..... 132/320, 108, 119.1, 317, 318, 288, 132/293, 297, 298, 73.6, 75.8; 601/17, 18, 601/46, 89, 97, DIG. 15, 70, 72; 15/229.14; 401/130, 261, 266, 200; 331/113 R, 331/143, 187

See application file for complete search history.

(56) References Cited

U.S. PATENT DOCUMENTS

| | | | | |
|---|---|---|---|---|
| 6,352,518 | B1 * | 3/2002 | nee Wolf | 601/89 |
| 7,282,036 | B2 * | 10/2007 | Masuda | 601/72 |
| 7,306,569 | B2 * | 12/2007 | LaJoie et al. | 601/70 |
| 7,386,906 | B2 * | 6/2008 | Roth et al. | 15/28 |
| 7,789,092 | B2 * | 9/2010 | Akridge et al. | 132/200 |
| 8,561,241 | B2 * | 10/2013 | Lim et al. | 15/22.2 |
| 2004/0267170 | A1 * | 12/2004 | Liste et al. | 601/17 |

(Continued)

FOREIGN PATENT DOCUMENTS

| | | | |
|---|---|---|---|
| KR | 20-0348032 | B1 | 4/2004 |
| KR | 20-0365249 | B1 | 10/2004 |

*Primary Examiner* — Vanitha Elgart

(74) *Attorney, Agent, or Firm* — John K. Park; Park Law Firm

(57) ABSTRACT

Provided is a puff, which enables the user to apply and spread color cosmetics such as a compact or foundation evenly to the skin so as to be have a sensation of close contact, more specifically, a separable variation puff which is configured such that: various puff members are connectable to or separable from a lower side of a coupling main body having a holding part; an elastic moving body into which an oscillator is inserted is connected to and formed at an inner side of the coupling main body; power of the oscillator is controlled by a battery and a switch; and the battery is easily exchangeable through the lower side of the coupling main body. Thus, the puff is advantageous in that the user can effectively transmit vibration of the oscillator to the puff according to a contact degree of the puff to the user's skin.

5 Claims, 7 Drawing Sheets

(56) References Cited

U.S. PATENT DOCUMENTS

| | | | | |
|---|---|---|---|---|
| 2006/0010625 | A1* | 1/2006 | Tapper et al. | 15/97.1 |
| 2006/0021169 | A1* | 2/2006 | Choo | 15/97.1 |
| 2006/0058714 | A1* | 3/2006 | Rhoades | 601/73 |
| 2008/0104787 | A1* | 5/2008 | Keenan et al. | 15/210.1 |
| 2008/0292386 | A1* | 11/2008 | Lee | 401/202 |
| 2010/0300479 | A1* | 12/2010 | Reishus et al. | 132/320 |
| 2011/0258791 | A1* | 10/2011 | Batchvarova et al. | 15/3 |
| 2011/0270274 | A1* | 11/2011 | Hull, Jr. | 606/131 |
| 2012/0121309 | A1* | 5/2012 | Liu | 401/6 |
| 2013/0156487 | A1* | 6/2013 | Haan | 401/143 |
| 2014/0216496 | A1* | 8/2014 | Fang et al. | 132/320 |

* cited by examiner

VIBRATION PUFF HAVING ELASTIC MOVING BODY INSIDE

TECHNICAL FIELD

The present invention relates, in general, to a puff which enables a user to spread and apply color cosmetics such as a compact or foundation evenly to the skin so as to have a sensation of close contact, more specifically, to a separable variation puff, which is configured such that: an elastic moving body which is equipped with an oscillator is connected into a coupling main body having a holding part; the oscillator within the elastic moving body is operated by a switch and a battery; and puff members in various shapes are detachable from a lower side of the coupling main body, whereby thanks to the improved vibration force of the oscillator transmitted to the puff members through the elastic moving body, a user can more conveniently put on makeup.

BACKGROUND ART

In general, when a person wants to naturally cover blemishes or freckles on exposed areas of skin such as the face, or to have clean and bright skin or pure and soft skin, the person uses powder cosmetics (hereinafter referred to as "the cosmetics") such as a foundation, a skin cover or a twin cake.

The cosmetics should be evenly spread and applied to a region intended for makeup without being condensed so as to have a sensation of close contact. In addition, to satisfy an emotional sensation of use, the user puts on makeup by hand, and at this time, a puff for makeup is used.

The puffs used for makeup to which the cosmetics are applied are a puff, which is configured so that the user can spread and apply the cosmetics while lightly patting the region for makeup with a surface of the puff to which the cosmetics are applied by inserting the finger into a finger inserting band formed at one side of the puff, and a vibration puff, which enables the user to put on makeup while automatically patting the region for makeup with the puff.

Of the puffs, when the puff, which can be used in a state of the finger being inserted into the finger inserting band, is used, the user pats the skin with the puff by artificial power, so it is inconvenient to apply makeup. In addition, in the case of a person who does not apply makeup frequently, or applies makeup clumsily, because the person's patting power is not regular, a case in which makeup does not take is generated, and because a patting speed by hand has a limit, the person cannot rapidly put on makeup.

Thus, as a puff which is configured so that the user can apply makeup while automatically patting a region for makeup with the puff, vibration puffs were suggested by Utility Model Reg. No. 348032 and Utility Model Reg. No. 365249.

The vibration puff of the prior registered device is configured such that a puff head is installed at an operating shaft installed to protrude to one side of a sack type case, and the operating shaft performs a seesaw motion around a hinge due to a turning force of an electric motor, so the head puff installed at the operating shaft performs a reciprocating motion in front and rear directions.

However, as described above, the vibration puff of the prior registered device configured so as to apply makeup by automatically vibrating the puff is advantageous because it is convenient to apply makeup compared to the puff configured so as to use in a state of inserting the finger. However, because the head puff is installed at the operating shaft which moves in the front and rear directions due to the seesaw motion, a stroke length in which the puff head moves in the front and rear directions due to the seesaw motion can only elongate. Thus, it is disadvantageous because patting speed is slow and patting power is strongly generated, so the user cannot apply makeup while feeling a soft sensation of touch. Also, because of a distance between the puff head and the case to be held by hand, the sensations of touch which a person is able to feel in the region for makeup, and which is then transmitted to the hand, can only be different from each other. In addition, because the structure thereof is complex, there is a difficulty in realizing its small size and light weight.

Moreover, the vibration puff as described above requires excessive configurations and devices to have a vibration means, and thus is very different from a normal puff, namely, a circular puff in a round shape, with respect to the shape and method of use. Accordingly, the puff has a harmful effect which cannot by easily used by consumers.

DISCLOSURE

Technical Problem

Accordingly, the present invention has been made keeping in mind the above problems occurring in the related art, and is intended to provide a separable vibration puff equipped with an elastic moving body, which is characterized in that a puff member which is convenient to use and is suitable to a user's taste can be selected and applied, and a battery can be exchanged, thereby being capable of largely extending a useable lifespan.

Technical Solution

In one aspect, the present invention provides a separable vibration puff which is configured such that: various puff members are formed to be connectable to or separable from a lower side of a coupling main body having a holding part; an elastic moving body into which an oscillator is inserted is formed to be connected to an inner side of the coupling main body; power of the oscillator is controlled by a battery and a switch; and the battery is exchangeable conveniently through the lower side of the coupling main body which is opened.

Advantageous Effects

As described above, the separable variation puff according to the present invention is advantageous because the user can effectively transmit vibration of the oscillator to the puff according to a contact degree of the puff to the user's skin, and the user can more easily put on makeup and can also apply makeup so as to have the desirable sensation of close contact. Furthermore, because the puff is easy to use, and is exchangeable for puff members having various shapes, the user can more effectively apply makeup, and because the battery is easily exchanged, a useable lifespan can be maximized, meaning that the puff is very economical.

BEST MODE

In order to achieve the above object, the present invention serves to provide a separable vibration puff having an elastic moving body inside, including: a coupling main body having a holding part with a narrow upper portion and a wide lower portion at an upper side thereof, and an inner space, which is opened, at a lower side thereof; and a puff member formed to be detachable from the lower side of the coupling main body, wherein a switch exposed to the outside is connected to and formed in the holding part, wherein a mounting plate is connected to and formed in the inner space of the coupling main body, wherein battery terminals connected to the switch are fixedly formed on an upper surface of the mounting plate, wherein an insertion hole, which is configured so that a battery may be inserted between the battery terminals, is formed to pass through the mounting plate, wherein a soft elastic moving body into which an oscillator is inserted is connected to and formed in a central portion of the mounting plate, whereby a lower portion of the elastic moving body comes into contact with the puff member connected to the lower side of the coupling main body so that vibration force of the elastic moving body due to the oscillator is transmitted to the puff member.

MODE FOR INVENTION

Hereinafter, the preferred embodiment of the present invention will be described in detail with reference to the accompanying drawings. The terminologies or words used in the description and the claims of the present invention should not be interpreted as being limited merely to their common and dictionary meanings. On the contrary, they should be interpreted based on the meanings and concepts of the invention in keeping with the scope of the invention based on the principle that the inventor(s) can appropriately define the terms in order to describe the invention in the best way.

Reference will now be made in greater detail to a preferred embodiment of the invention with reference to the accompanying drawings.

Figure 1:
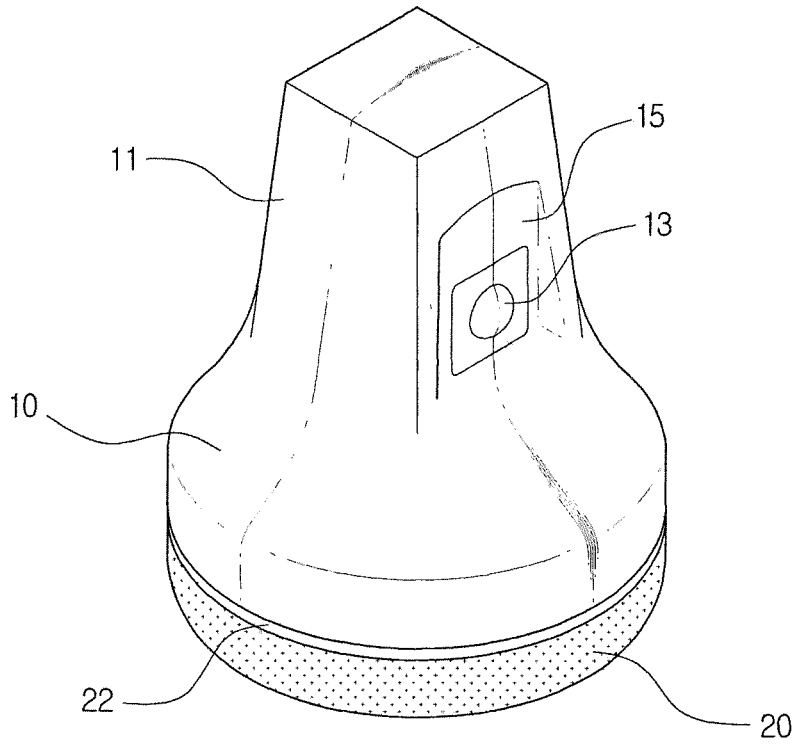
FIG. 1 is a whole perspective view of a vibration puff according to the present invention.
Figure 2:
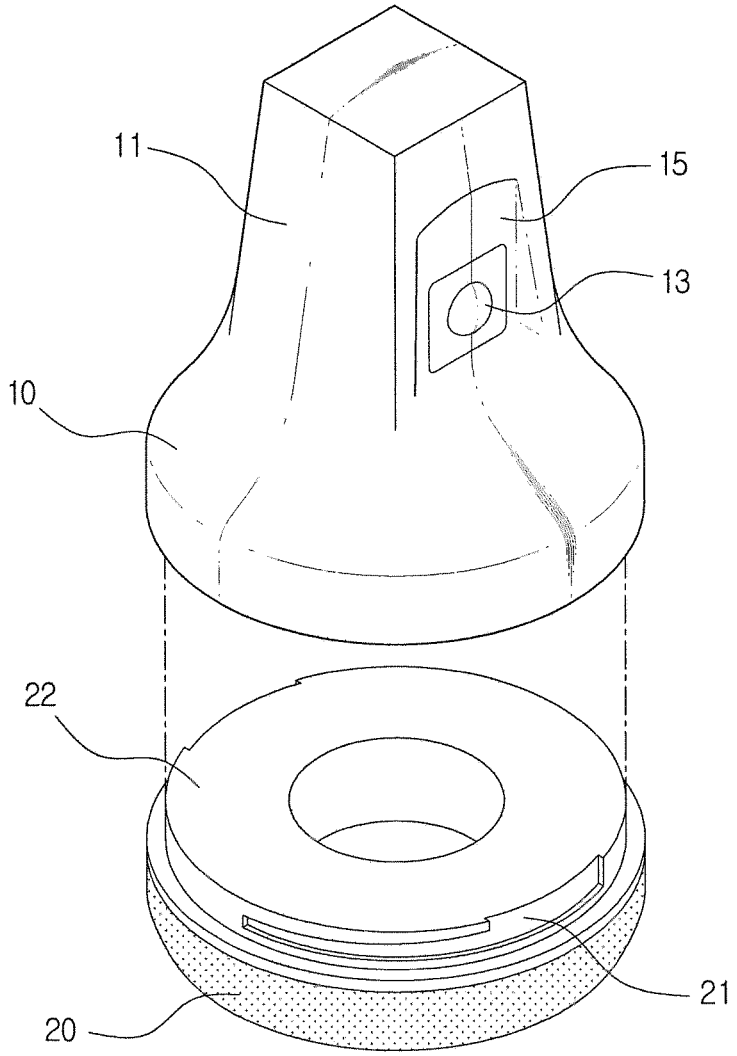
FIG. 2 is a separated perspective view of the vibration puff according to the present invention.
Figure 3:
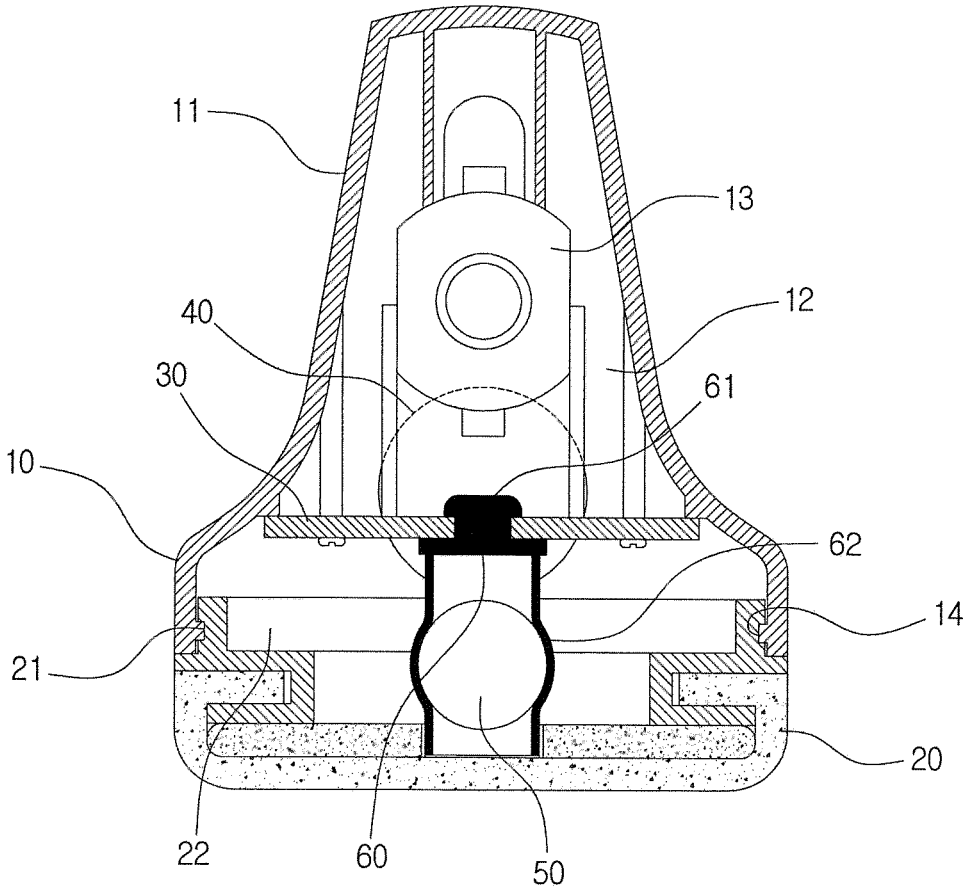
FIG. 3 is a whole cross-sectional view of the vibration puff according to the present invention.
Figure 4:
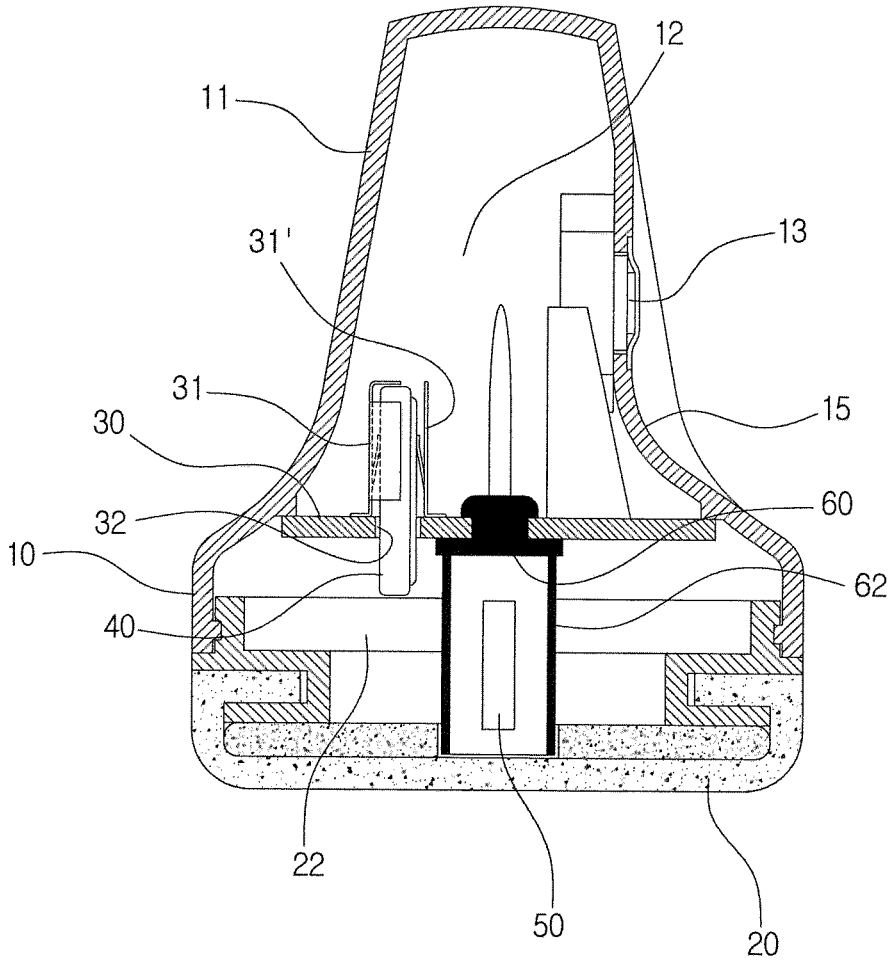
FIG. 4 is another cross-sectional view of the vibration puff according to present invention.

FIG. 1 is a whole perspective view of a vibration puff according to the present invention, FIG. 2 is a separated perspective view of the vibration puff according to the present invention, FIG. 3 is a whole cross-sectional view of the vibration puff according to the present invention, and FIG. 4 is another cross-sectional view of the vibration puff according to present invention.

As illustrated, the vibration puff according to the present invention is composed of a coupling main body 10 which is designed to be used in a state of being held directly by hand, and a puff member 20 which is connectable to or separable from the coupling main body 10 and is able to be used on the skin for applying cosmetics thereto.

In such a vibration puff, the coupling main body 10 is produced by injection molding synthetic resins, and a holding part 11 is formed at its upper side and an inner space 12 is formed at its lower side which is open. The holding part 11 is configured such that an upper portion thereof is narrow and a lower portion thereof becomes wide gradually so that it can be conveniently held and used by a user, and the inner space 12 may contain a built-in power source and vibration means.

Also, in the coupling main body 10, a switch 13 exposed to the outside is connected to and formed on one side, and at least two coupling protrusions 14 are formed to protrude at an inner side of the opened lower portion. Here, the switch 13 is located on one surface of the holding part 11, and a recessed part 15 is partially formed on the one surface of the holding part 11. As the switch 13 is located within the recessed part 15 to be exposed, although a contact with the holding part 11 is generated from the outside or external force is operated, the switch 13 within the recessed part 15 is not operated, thereby preventing the switch 13 from being operated unnecessarily due to interference of other objects in a bag. The recessed part 15 is large enough so that the user's fingertip can be suitably inserted, so the user can operate and use the switch 13 only when necessary.

Also, a separate mounting plate 30 is connected to and formed in the inner space 12 of the coupling main body 10, and battery terminals 31, 31' spaced apart from each other are fixed to an upper surface of the mounting plate 30 in a state of being electrically connected to the switch 13. An insertion hole 32, which is configured so that its top and bottom pass through each other, is formed in the mounting plate 30 corresponding to a spaced gap between the battery terminals 31, 31'. Thus, when from a bottom surface of the mounting plate (30), a separate battery 40 is inserted into the insertion hole 32, fixing and connecting states of the battery 40 are realized due to elastic and virtual pressure of the battery terminals 31, 31' formed by bending a metal board.

In particular, when the battery 40 is inserted into the insertion hole 32, only a part of the battery 40 comes into contact with the battery terminals 31, 31', and another part is exposed to a lower side of the mounting plate 30. Thus, when the battery 40 is exhausted, the battery 40 may be pulled out from the lower side of the mounting plate 30 and may be replaced by a new battery which is inserted. For this, the battery terminals 31, 31' have a hook part formed by bending to prevent the battery 40 from being excessively inserted thereto. Furthermore, a partially cut banding part may be formed to improve fixing strength with the battery 40.

Also, from a bottom surface, a separate elastic moving body 60 is fixedly inserted into a middle portion of the mounting plate 30. The elastic moving body 60 is made of a material which has excellent elasticity and softness such as silicon. An insertion protrusion 61 to be inserted and fixed into the mounting plate 30 is formed at an upper side, and a pipe-shaped insertion tube 62 is formed at a lower side. Furthermore, a separate oscillator 50 is inserted into and formed in an inner side of the insertion tube 62.

At this time, the oscillator 50 has a button type structure which is widely used in cases intended to realize a vibration mode, such as in a cellular phone and the like. An internal diameter of the insertion tube 62 is formed to be narrow compared to an external diameter of the oscillator 50. When the oscillator 50 is forcibly inserted into the inner side of the insertion tube 62, a middle portion of the insertion tube 62 is deformed into a bulging shape. At the same time, the insertion tube may be located and fixed surrounding the oscillator 50.

In a state of the oscillator 50 being located in the middle portion of the soft elastic insertion tube 62, when power of the battery 40 connects with the oscillator 50 through the switch 13, the oscillator 50 to which the power of the battery 40 is applied vibrates in countless numbers due to the operation of the switch 13. This vibration force is completely transmitted to the soft elastic moving body 60, causing the insertion tube 62 made of a soft elastic material to move violently, thereby doubling the vibration force.

In particular, the elastic moving body 60 functions both to double the vibration force of the oscillator and to completely maintain the vibration force due to the soft elasticity, even when the user presses the puff against the skin. Conventional vibration means and vibration transmitting means have a shape in which the vibration means comes into contact directly with the puff. Thus, in the case where the puff comes into close contact with the skin by applying pressure to the skin through the puff, excessive vibration is transmitted to the skin, and in the case where the puff is lightly pressed against the skin, vibration is not effectively transmitted to the skin. However, since the elastic moving body 60 of the present invention has flexibility itself, in the case where the puff is excessively pressed against the skin, the elastic moving body absorbs virtual pressure due to stress itself. Also, in the case where the puff is lightly pressed against the skin, the speed of movement of the elastic moving body 60 increases, and vibration transmitting force to the skin also increases, thereby enabling the puff to constantly transmit satisfactory vibration force regardless of a contact degree of the puff to the skin.

Also, the puff member 20 is configured such that a fixture is injected and molded with synthetic resins and is located at an upper portion thereof. An insertion groove 21 corresponding to a coupling protrusion 14 formed on an inner side of the lower portion of the coupling main body 10 is formed on an outer surface of the fixture 22. The fixture 22 of the puff member 20 is located at the lower side of the coupling main body 10 so that the coupling protrusion 14 and the insertion groove 21 correspond to be rotated and assembled together.

At this time, the upper surface of the inner side of the puff member 20 comes into surface contact with a lower end of the elastic moving body 60, or when the lower end of the elastic moving body 60 is inserted into the inner side of the puff member 20, the vibration force of the oscillator 50 is transmitted to the puff member 20 in a state of being amplified by the elastic moving body 60, and thus the vibration having a more improved amplitude than the amplitude provided by the oscillator 50 is actually transmitted to the puff member 20, thereby improving the vibration effect of the conventional vibration puff.

Figure 5:
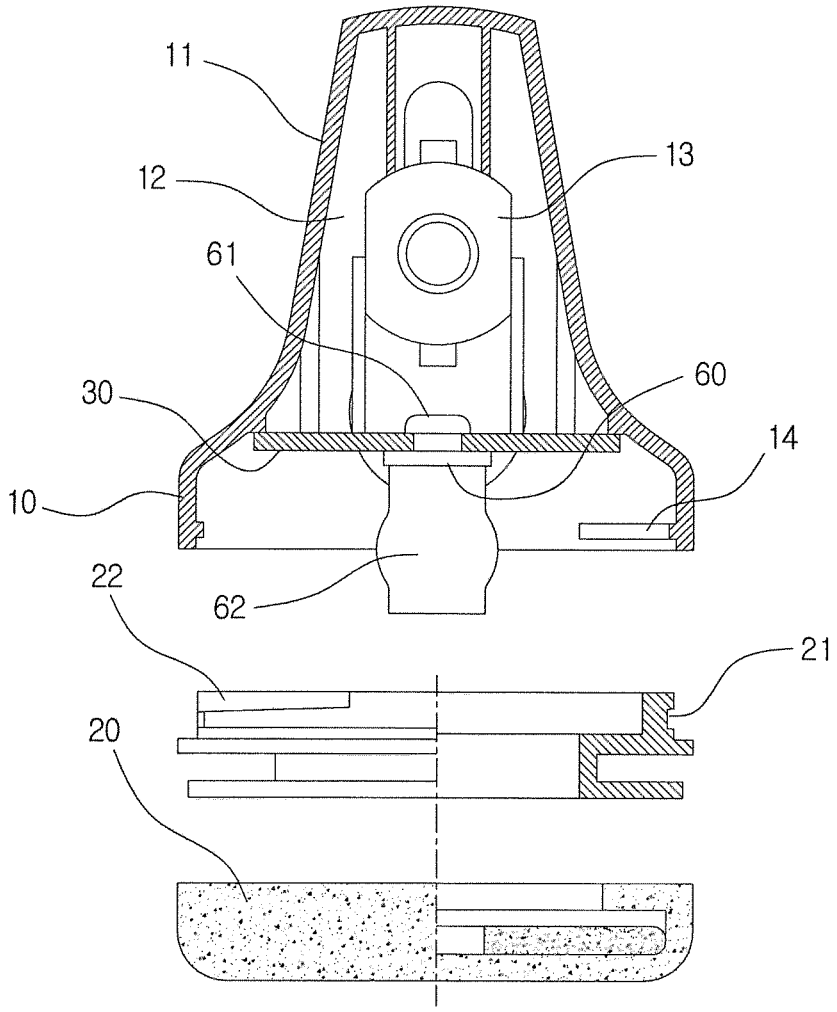
FIG. 5 is a separated cross-sectional view of the vibration puff according to the present invention.
Figure 6:
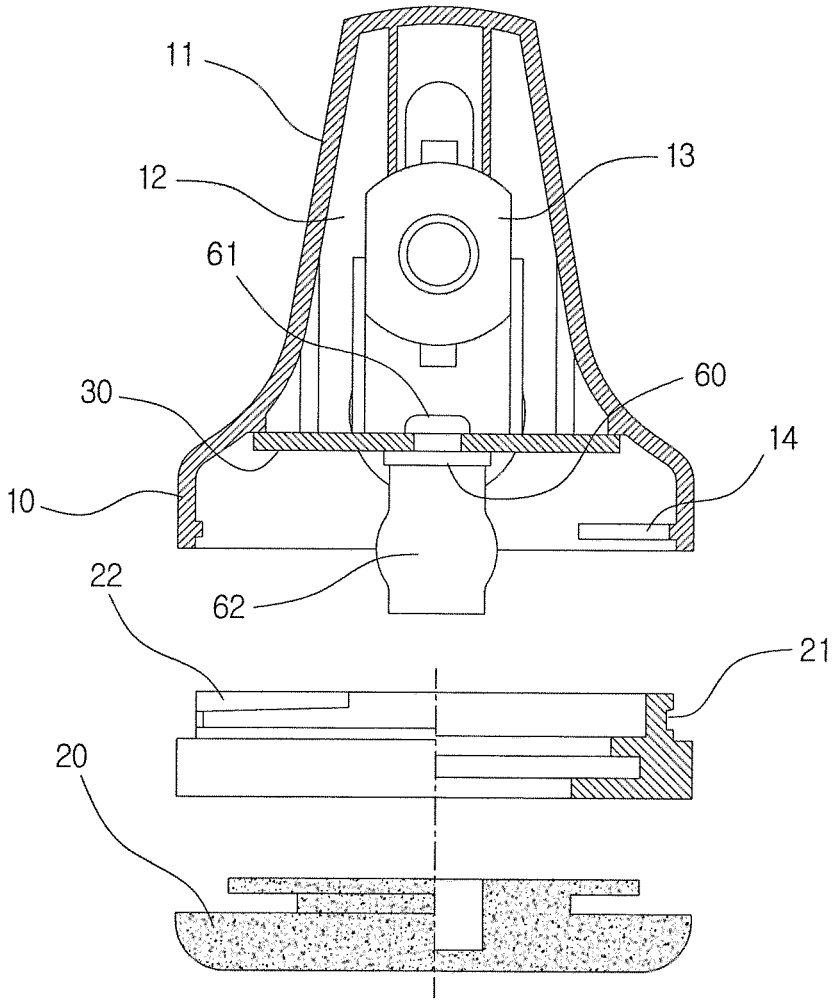
FIG. 6 is a separated cross-sectional view to which other puff member of the vibration puff according to the present invention is applied.

In particular, the puff member 20 may be assembled and used in various shapes which are selected according to the user's convenience and taste. As illustrated in FIG. 5, a shape in which the puff member 20 is connected to surround the external surface of a lower side of the fixture 22 may be used. As illustrated in FIG. 6, a shape in which a front end of the puff member 20 is fixedly inserted into an inner side of the lower portion of the fixture 22 may be used. As the need arises, a relatively hardened or cured sponge or rubber pad is additionally inserted into the inner side of each puff member 20 so that a vibration effect can be doubled.

The puff member 20 is easily separated from and connected to the coupling body 10, thereby being capable of cleaning and reusing the puff member 20 polluted by cosmetics. When the puff member is damaged and its lifespan is completed, only the puff member 20 must be newly purchased, so the puff is very economical. Also, the puff member 20 in various shapes and having the fixture 22 with a structure which is connectable to the coupling main body 10 may be selectively purchased and may be used according to the user's taste or purpose. Thus, by using the coupling main body 10 of a single object, the puffs having various shapes can be effectively selected and used.

Figure 7:
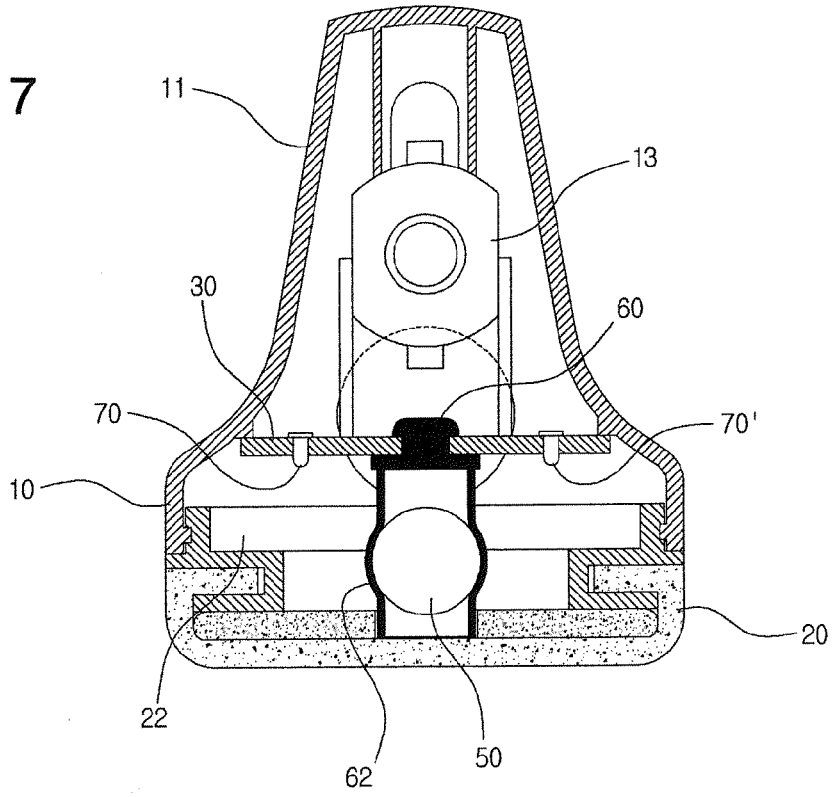
FIG. 7 and FIG. 8 are cross-sectional views showing other embodiments of the vibration puff according to the present invention.

Also, as illustrated in FIG. 7, separate LEDs 70, 70' are fixed to the fixture 22, and a lighting beam of LEDs 70, 70' is directed toward the puff member 20. Also, as the oscillator 50 operates, lighting of the LEDs 70, 70' occurs. Thus, in the case where makeup is applied based on the oscillator 50, the lighting beam of the LEDs 70, 70' is softly reflected to the outside while transmitting the puff member 20 in a sponge shape, thereby creating elegant decorativeness. As a result, user satisfaction is increased.

Figure 8:
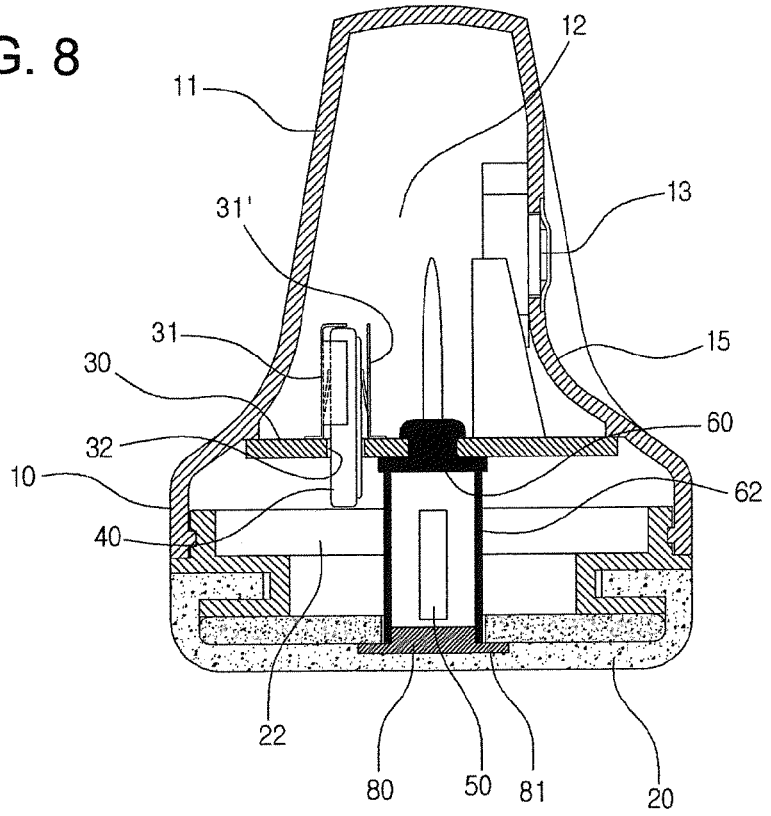

In particular, as illustrated in FIG. 8, a separate diffusion cap is connected to and is formed at a lower end of the elastic moving body 60 of the insertion tube 62 as described above. A diffusion flange part 81, which is wider than an external diameter of the insertion tube 62, is formed at a lower portion of the diffusion cap 80, thereby enabling a bottom surface of the diffusion flange part 81 to be closely adhered to an inner surface of the puff member 20. Thus, when vibration force of the oscillator 50, which is operated by applying power thereto, is transmitted to the puff member 22 through the insertion tube 62 and the diffusion cap 80, it causes vibration to be effectively and uniformly diffused over a wider area through the diffusion flange part 81.

Accordingly, because the vibration puff of the present invention is composed of a relatively simple structure, productivity is excellent. Also, the vibration puff was mainly developed based on the user's convenience, so the puffs having various shapes can be exchanged and used, and the battery can also be exchanged, thereby maximizing the vibration puff's useable lifespan.

Although the embodiments of the present invention have been disclosed for illustrative purposes, those skilled in the art will appreciate that various modifications, additions and substitutions are possible, without departing from the scope and spirit of the invention as disclosed in the accompanying claims and their equivalents.

The invention claimed is:

1. A separable vibration puff having an elastic moving body inside, comprising:

a coupling main body (10) having a holding part (11) with a narrow upper portion and a wide lower portion at an upper side of the coupling main body (10), and an inner space (12), which is opened at a lower side of the coupling main body (10); and a puff member (20) formed to be detachable from the lower side of the coupling main body (10), wherein a switch (13) exposed to an outside is connected to and formed in the holding part (11), wherein a mounting plate (30) is connected to and formed in the inner space (12) of the coupling main body (10), wherein battery terminals (31) (31') connected to the switch (13) are fixedly formed on an upper surface of the mounting plate (30), wherein an insertion hole (32), which is configured so that a battery (40) may be inserted between the battery terminals (31) (31'), is formed to pass through the mounting plate (30), wherein a soft elastic moving body (60) into which an oscillator (50) is inserted is connected to and formed in a central portion of the mounting plate (30), whereby a lower portion of an elastic moving body (60) comes into contact with the puff member (20) connected to the lower side of the coupling main body (10) so that vibration force of the elastic moving body (60) due to the oscillator (50) is transmitted to the puff member (20), wherein the elastic moving body (60) is configured such that an insertion protrusion (61) connected to the mounting plate (30) is formed to protrude at a front end, an insertion tube (62) is formed at a lower side, wherein the insertion tube (62) is configured to have a smaller internal diameter than an external diameter of the oscillator (50), whereby the oscillator (50) is inserted while deforming the insertion tube (62) so that their insertion and fixation are performed mutually, wherein the oscillator (50) is located in a middle portion of the insertion tube (62), so when the oscillator (50) operates, the insertion tube (62) moves while amplifying vibration force of the oscillator (50).

2. The separable vibration puff according to claim 1, wherein the coupling main body (10) has a coupling projection (14) formed to protrude at an inner side of its lower portion, and the puff member (20) is configured such that a fixture (22) made by forming an insertion groove (21) on an external side is connected to and formed at an upper portion, and thus by an engaging combination and separation of the coupling projection (14) and the insertion groove (21), the puff member (20) is exchangeable from and connectable to the coupling body (10).

3. The separable vibration puff according to claim 1, wherein LEDs (70, 70') connected to the battery (40) are fixedly formed in the mounting plate (30), and a lighting beam of LEDs (70, 70') is transmitted to the outside through the puff member (20).

4. The separable vibration puff according to claim 1, wherein a separate diffusion cap (80) is connected to and is formed at a lower end of the insertion tube (62) so that a bottom surface of the diffusion cap (80) comes into contact with an inner surface of the puff member (20), thereby enabling vibration to be diffused, and a diffusion flange part 81 for widening a diffusion area is formed at a lower portion of the diffusion cap 80.

5. The separable vibration puff according to claim 1, wherein a recessed part (15) is formed on one surface of the holding part (11), and the switch (13) is located within the recessed part (15) to prevent the switch being exposed to the outside from being operated due to interference from objects on the outside affecting the holding part (11).

* * * * *